US009008523B2

(12) United States Patent
Takahashi

(10) Patent No.: US 9,008,523 B2
(45) Date of Patent: Apr. 14, 2015

(54) IMAGE FORMING APPARATUS, METHOD OF CONTROLLING THE SAME, AND STORAGE MEDIUM

(71) Applicant: Canon Kabushiki Kaisha, Tokyo (JP)

(72) Inventor: Toru Takahashi, Kawasaki (JP)

(73) Assignee: Canon Kabushiki Kaisha (JP)

( * ) Notice: Subject to any disclaimer, the term of this patent is extended or adjusted under 35 U.S.C. 154(b) by 9 days.

(21) Appl. No.: 13/888,549

(22) Filed: May 7, 2013

(65) Prior Publication Data

US 2013/0294785 A1 Nov. 7, 2013

(30) Foreign Application Priority Data

May 7, 2012 (JP) ..... 2012-105994

(51) Int. Cl.
*G03G 15/00* (2006.01)

(52) U.S. Cl.
CPC ..... *G03G 15/70* (2013.01); *G03G 15/602* (2013.01)

(58) Field of Classification Search
USPC ..... 399/21, 81, 365, 363, 367, 18, 22, 17, 399/125, 388; 271/9.13
See application file for complete search history.

(56) References Cited

U.S. PATENT DOCUMENTS 4,959,684 A * 9/1990 Ito ..... 355/55
5,034,780 A * 7/1991 Kotabe et al. ..... 399/21

FOREIGN PATENT DOCUMENTS

JP 2000-185881 A 7/2000

* cited by examiner

*Primary Examiner* — Matthew G Marini
(74) *Attorney, Agent, or Firm* — Rossi, Kimms & McDowell LLP

(57) ABSTRACT

An image forming apparatus capable of distinguishing whether paper material retained in a sheet conveying path is an original or a recording material. An image forming apparatus includes an image reading unit that reads an original, a photosensitive drum that forms an image on a recording sheet, and a main motor and a double-sided-printing drive motor which convey the original and the recording sheet. Paper sheet sensors detect an occurrence of a jam of the original or the recording sheet. When a paper jam is detected, a CPU controls a display section to display a plurality of sheets retained in a conveying path, in a manner distinguishing between the original and the recording material.

8 Claims, 14 Drawing Sheets

IMAGE FORMING APPARATUS, METHOD OF CONTROLLING THE SAME, AND STORAGE MEDIUM

BACKGROUND OF THE INVENTION

1. Field of the Invention

The present invention relates to an image forming apparatus, a method of controlling the image forming apparatus, and a storage medium.

2. Description of the Related Art

Conventionally, in an image forming apparatus, an original conveying system of an image reading unit that conveys an original and reads an image of an original being conveyed, and a recording material-conveying system of a printing unit for conveying recording materials are constructed independently of each other.

More specifically, the original conveying system and the recording material-conveying system are each provided, independently of each other, with a sheet feeder from which storing originals or recording materials are fed, a sheet feeding unit, guiding members for forming predetermined conveying paths, and so on. Further, the original conveying system and the recording material-conveying system are each provided with a plurality of conveying roller pairs, drive force transmission units for transmitting drive forces to the plurality of conveying roller pairs, motors as drive sources, drive circuits of the motors, a sheet discharging section, and so on.

For this reason, it has been inevitable that the entire mechanism construction of the image forming apparatus becomes increasingly complex and the cost and size of the apparatus are increased.

To solve these problems, there has been proposed an image forming apparatus in which an image reading unit is provided in a recording material-conveying path extending from a sheet feeder to a sheet discharger, whereby respective path sections of the original conveying system and the recording material-conveying system are formed as a section which can be shared between the two systems, to thereby attain reduction of the size of the image forming apparatus (see e.g. Japanese Patent Laid-Open Publication No. 2000-185881).

However, the image forming apparatus disclosed in Japanese Patent Laid-Open Publication No. 2000-185881 has the image reading unit arranged in an intermediate portion of the recording material-conveying path e.g. between a fixing device and the sheet discharger, and hence an original conveying path for conveying an original to be read becomes long. This configuration makes it difficult to reduce time for reading the original.

Further, since the image reading unit is provided in the recording material-conveying path used for usual printing, when an original is in the recording material-conveying path, it is impossible to perform a printing operation. Therefore, it is required to stop the printing operation during an original reading operation.

Further, an original to be read and a print sheet are sometimes retained in the recording material-conveying path at the same time. In such a case, the user has to remove the original and the print sheet which are retained in the recording material-conveying path, and further set the removed original in an original feeding position again so as to cause reading of the original to be executed again, but it is difficult to distinguish which of the retained sheets is the original to be read and which of the same is the print sheet.

SUMMARY OF THE INVENTION

The present invention provides a mechanism capable of displaying a retained plurality of sheets in a manner distinguishing whether paper material retained in a sheet conveying path of an image forming apparatus is an original to be read or a recording material on which an image is to be formed.

In a first aspect of the present invention, there is provided an image forming apparatus comprising a reading unit configured to read an original, an image forming unit configured to form an image on a recording material, a conveying unit configured to convey the original and the recording material, a jam detection unit configured to detect an occurrence of a jam of the original or the recording material, and a display control unit configured to, when the occurrence of the jam is detected by the jam detection unit, control a display unit to display a plurality of sheets retained in a conveying path, in a manner distinguishing between the original and the recording material.

In a second aspect of the present invention, there is provided a method of controlling an image forming apparatus including a reading unit configured to read an original, an image forming unit configured to form an image on a recording material, and a conveying unit configured to convey the original and the recording material, the method comprising detecting an occurrence of a jam of the original or the recording material, and controlling, when the occurrence of the jam is detected by said detecting, a display unit to display a plurality of sheets retained in a conveying path, in a manner distinguishing between the original and the recording material.

In a third aspect of the present invention, there is provided a storage medium storing a program for causing a computer included in an image forming apparatus to execute a method of controlling the image forming apparatus including a reading unit configured to read an original, an image forming unit configured to form an image on a recording material, a conveying unit configured to convey the original and the recording material, wherein the method comprises detecting an occurrence of a jam of the original or the recording material, and controlling, when the occurrence of the jam is detected by said detecting, a display unit to display a plurality of sheets retained in a conveying path, in a manner capable of distinguishing whether each of the plurality of sheets is the original or the recording material.

According to the present invention, it is possible to provide a mechanism capable of distinguishing whether paper material retained in a sheet conveying path of an image forming apparatus is an original to be read or a recording material on which an image is to be formed.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof. Note that in the following description, processing for forming an image on a recording sheet (recording material) is sometimes expressed as printing.

Figure 1:
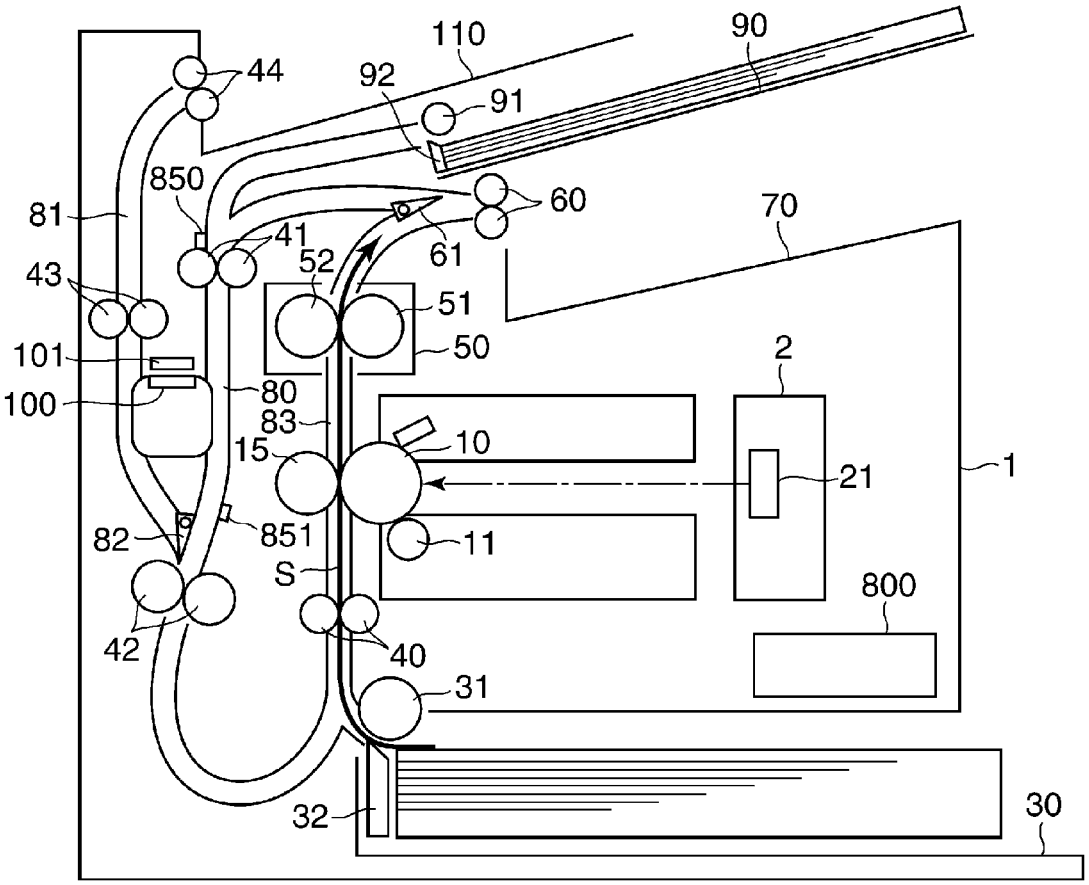
FIG. 1 is a schematic diagram of an image forming apparatus according to a first embodiment of the present invention.

FIG. 1 is a schematic diagram of an image forming apparatus 1 according to a first embodiment of the present invention.

In FIG. 1, the image forming apparatus 1 is provide with a shared conveying path 80, an original-dedicated conveying path 81, and an image-forming conveying path 83. Out of these, the shared conveying path 80 is a conveying path configured to be shared for both of conveyance of an original as an object to be read and conveyance of a recording sheet on which an image is to be formed during double-sided printing on the recording sheet. The original-dedicated conveying path 81 is used for conveying an original to be read. The image-forming conveying path 83 is a conveying path used for conveying a recording sheet when an image is printed on the recording sheet.

Along these conveying paths, a recording sheet is conveyed by a pickup roller 31, conveying roller pairs 40, 41, 42, 43, and 44, a heating roller 51, a pressure roller 52, a discharge roller pair 60, a double-sided-printing flapper 61, a switch-back flapper 82, and so forth. A pickup roller 91 and a sheet separator 92 convey originals placed in a second sheet feeder 90 to the conveying roller pair 41 one by one. Further, the originals are discharged by the conveying roller pair 44 onto a second discharge section 110.

Further, an image reading unit 100 as a reading unit that reads an original is configured to be rotatable. More specifically, the image reading unit 100 is rotatable such that it can selectively face a white reference member 101, the shared conveying path 80, and the original-dedicated conveying path 81. Further, the shared conveying path 80 is provided with paper sensors 850 and 851. The paper sensors 850 and 851 detect presence of a recording sheet S or an original G passing these sensors. These paper sensors 850 and 851 correspond to a detection unit configured to detect that paper material is retained in a conveying path.

Further, electrical equipment 800 controls the overall operation of the image forming apparatus 1. The construction of the electrical equipment 800 will be described hereinafter.

Hereafter, a description will be given of the image forming apparatus 1 by focusing on the movement of a recording sheet with reference to FIGS. 1 to 7. First, with reference to FIG. 1, a process up to the completion of single-sided printing or a process up to the completion of printing on one side of a sheet in double-sided printing will be described.

In FIG. 1, in the center of the image forming apparatus 1, there are provided a rotatable photosensitive drum 10 as an image bearing member, a developing roller 11 which is arranged in parallel with the photosensitive drum 10 and rotates while holding toner, and a transfer roller 15, which are component elements of an image forming unit configured to form an image on recording material.

Upon receipt of a print signal indicative of a print instruction from a host computer, not shown, or an operating section 870, referred to hereinafter, a light emitting section 21 provided in an optical unit 2 irradiates a surface of the rotating photosensitive drum 10 with laser beams. On the surface of the photosensitive drum 10 irradiated with the laser beams, an electrostatic latent image is formed.

The developing roller 11 supplies toner held therein onto the latent image on the surface of the photosensitive drum 10 while rotating, whereby a toner image is formed on the surface of the photosensitive drum 10.

On the other hand, the recording sheets S placed in a first sheet feeder 30 are conveyed by the pickup roller 31 and a sheet separator 32 to the conveying roller pair 40 one by one. The conveying roller pair 40 conveys each recording sheet S to the transfer roller 15 such that a toner image on the surface of the photosensitive drum 10 and a leading end of the recording sheet S meet at the transfer roller 15 in proper timing.

The toner image conveyed by rotation of the photosensitive drum 10 to the transfer roller 15 is transferred onto the recording sheet S by an applied bias voltage and pressure provided to the transfer roller 15. Further, the transfer roller 15 conveys the recording sheet S to a fixing section 50.

In the fixing section 50, the toner image is fixed onto the recording sheet S by heat from the rotatable heating roller 51 and pressure of the rotatable pressure roller 52 opposed to the heating roller 51. The recording sheet S having the toner image fixed thereon is conveyed to the discharge roller pair 60.

In the case of single-sided printing, the discharge roller pair 60 conveys the recording sheet S directly out onto a first discharge section 70, where the recording sheet S is stacked, whereby the single-sided printing is completed. To improve accuracy of alignment of the printed recording sheets, the first discharge section 70 is provided with a slope gradually rising from the vicinity of a discharge outlet in a recording sheet-discharging direction.

Figure 2:
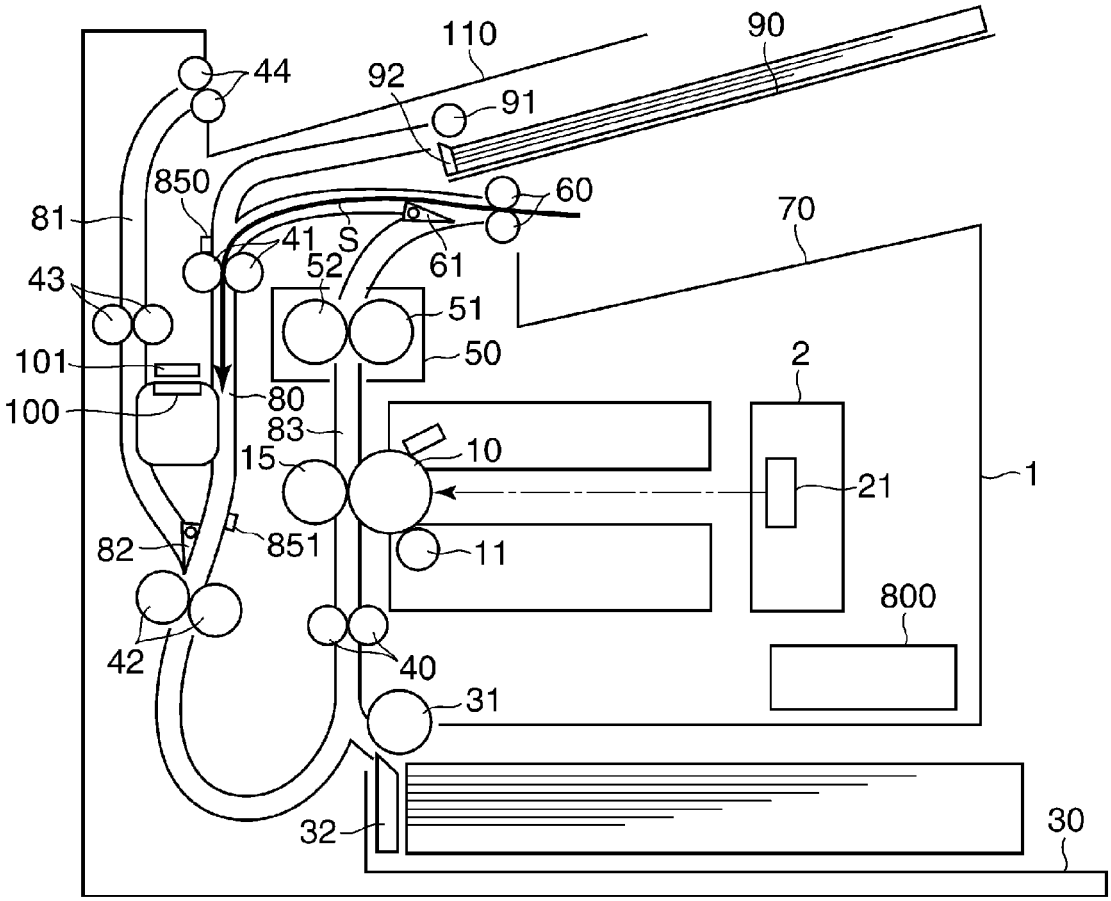
FIG. 2 is a schematic diagram of the image forming apparatus, which is useful in explaining a process up to the completion of double-sided printing.

On the other hand, in the case of double-sided printing, the recording sheet S is not conveyed out by the discharge roller pair 60, but is caused to switch back as described hereafter with reference to FIG. 2.

FIG. 2 is a schematic diagram of the image forming apparatus 1, which is useful in explaining a process up to the completion of double-sided printing.

Following the process described with reference to FIG. 1, particularly for double-sided printing, during conveyance of the recording sheet S by the discharge roller pair 60, when a trailing end of the recording sheet S passes the double-sided-printing flapper 61, the double-sided-printing flapper 61 switches the conveying path. Then, the discharge roller pair 60 is reversely rotated to convey the recording sheet S to the shared conveying path 80 to thereby cause the recording sheet S to switch back.

The recording sheet S caused to switch back is conveyed to the image reading unit 100 by the conveying roller pair 41. Then, the recording sheet S is conveyed again by the conveying roller pairs 42 and 40 to the transfer roller 15, where a toner image is transferred and fixed thereon, and then the recording sheet S is stacked on the first discharge section 70, thereby completing the double-sided printing.

Next, with reference to FIGS. 3 to 7, a process in which the image forming apparatus 1 reads both sides of an original and prints on both sides of a sheet will be described in detail.

Figure 3:
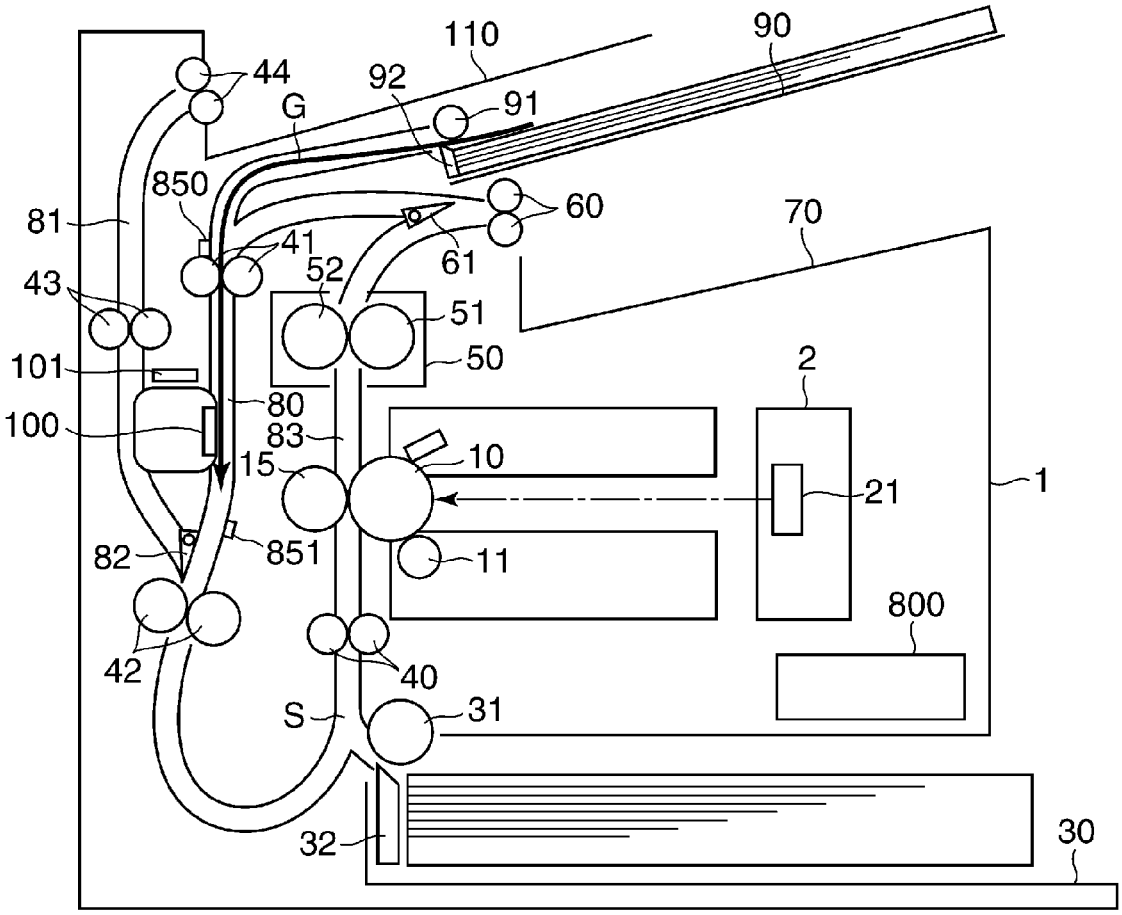
FIG. 3 is a schematic diagram of the image forming apparatus, which is useful in explaining a process up to the completion of reading of a front side of an original.

FIG. 3 is a schematic diagram of the image forming apparatus 1, which is useful in explaining a process up to the completion of reading of a front side of the original.

In FIG. 3, originals G set in the second sheet feeder 90 is conveyed to the conveying roller pair 41 by the pickup roller 91 and the sheet separator 92 one by one.

On the other hand, the image reading unit 100 performs correction of white reference values of the white reference member 101, and is then rotated to a position facing the shared conveying path 80 before the start of reading of a first side which is the front side of the original G fed from the second sheet feeder 90. The conveying roller pair 41 conveys the original G to the image reading unit 100.

At this time, the image reading unit 100 has already been waiting in a second reading position which is a position facing the shared conveying path 80, and one side of the original G is read by the image reading unit 100. The image data read by the image reading unit 100 is stored in an image memory 804 (see FIG. 8), referred to hereinafter, as the image data of the first side of the original.

Note that the white reference member 101 is disposed facing downward so as to prevent dust from attaching thereto.

Figure 4:
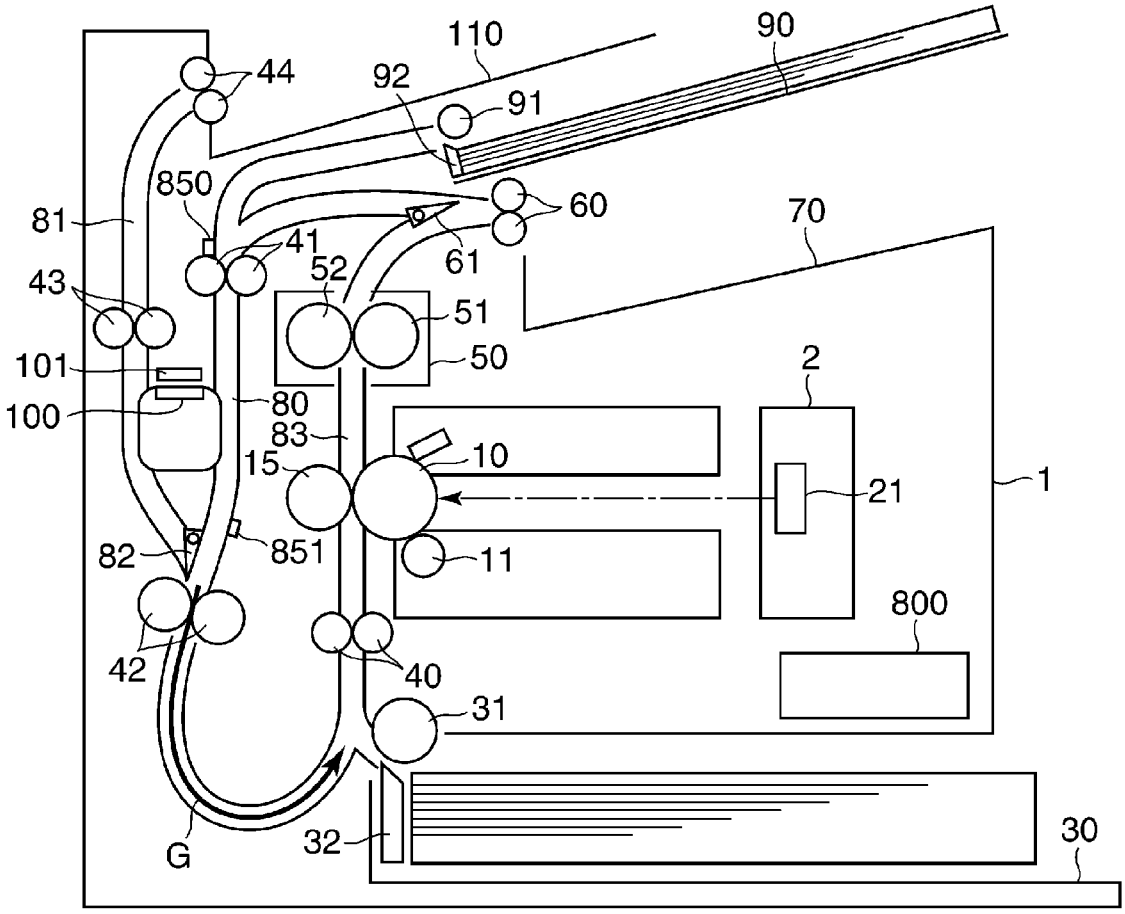
FIG. 4 is a schematic diagram of the image forming apparatus, which is useful in explaining operations performed on the original after reading the front side thereof.

FIG. 4 is a schematic diagram of the image forming apparatus 1, which is useful in explaining operations performed on the original G after reading the front side thereof.

In FIG. 4, the original G having passed the image reading unit 100 is conveyed to the conveying roller pair 42. The conveying roller pair 42 is stopped at a time point when the trailing end of the original G passes the switchback flapper 82. Therefore, the original G is at rest in a state sandwiched by the conveying roller pair 42. After the elapse of a predetermined time period, the original G is conveyed from this state to the original-dedicated conveying path 81.

More specifically, the image reading unit 100 reads a white reference image and a black reference image from the white reference member 101 when the image reading unit is in a position facing the white reference member 101, where the image reading unit 100 is halfway through rotation to the position facing the original-dedicated conveying path 81, which is performed so as to read a second side of the original. The image reading unit 100 reads the white reference image and the black reference image from the white reference member 101 before the start of reading of the second side which is a reverse side of the original.

Figure 5:
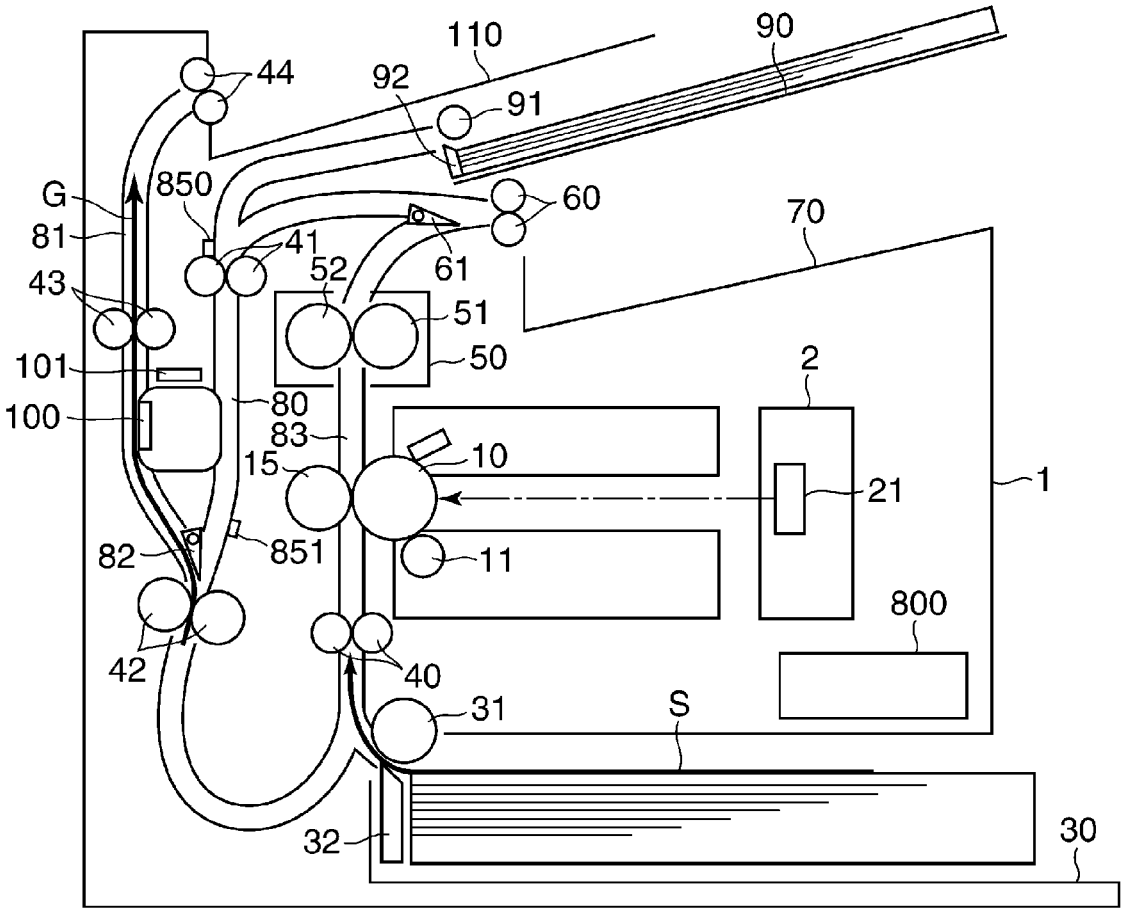
FIG. 5 is a schematic diagram of the image forming apparatus, which is useful in explaining a process for reading a reverse side of the original.

FIG. 5 is a schematic diagram of the image forming apparatus 1, which is useful in explaining a process for reading the reverse side of the original.

In FIG. 5, almost as soon as the switchback flapper 82 switches the destination of conveying the original G from the shared conveying path 80 to the original-dedicated conveying path 81, the image reading unit 100 is rotated to a first reading position which is the position facing the original-dedicated conveying path 81.

When the conveying roller pair 42 is reversely rotated, the original G is conveyed to the image reading unit 100 along the original-dedicated conveying path 81.

The original G is conveyed to the image reading unit 100, and as it passes the image reading unit 100, the second side thereof is read and stored in the image memory 804 as the image data of the second side.

On the other hand, the recording sheets S are fed from the first sheet feeder 30 and conveyed to the conveying roller pair 40 one by one. Almost simultaneously when a recording sheet S is fed from the first sheet feeder 30, a latent image is formed on the photosensitive drum 10 by the light emitting section 21 based on the image data of the second side of the original G, which is stored in the image memory 804.

Next, a toner image formed based on the latent image is transferred onto the recording sheet S by the transfer roller 15, and then the recording sheet S is conveyed to the fixing section 50, and so forth, whereby printing on the second side is completed. As described above, printing on the reverse side is performed first.

Although in FIG. 5, feeding of the recording sheet S is started at the start of reading of image data on the second side, the recording sheet S may be conveyed after the image data on the second side has been read. As described above, the conveying paths include the conveying path for the image reading unit 100 to read one side of the original and the conveying path for reversing the original so as to read the other side of the original.

Figure 6:
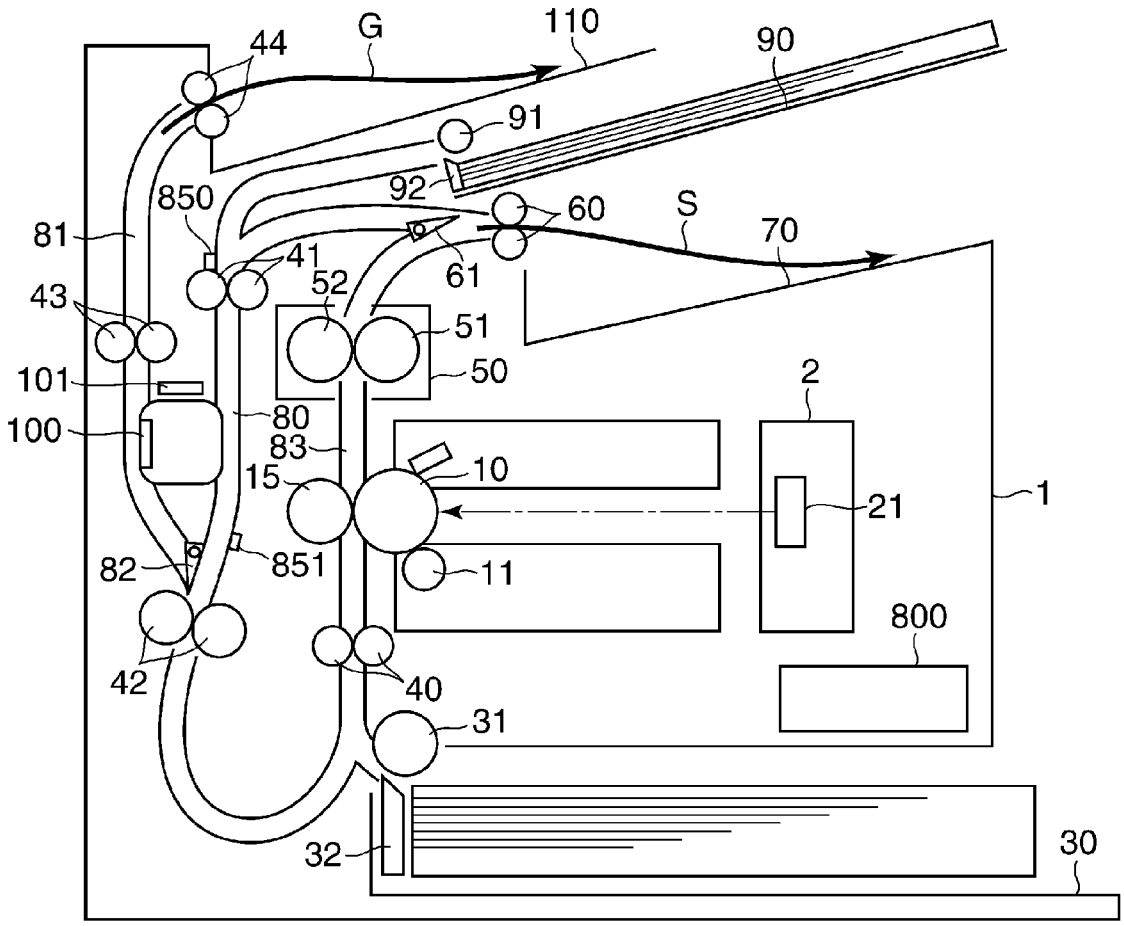
FIG. 6 is a schematic diagram of the image forming apparatus, which is useful in explaining a state thereof at a time when reading of the reverse side of the original is completed.

FIG. 6 is a schematic diagram of the image forming apparatus 1, which is useful in explaining a state thereof at a time when reading of the reverse side of the original is completed.

The original G which has been read is conveyed to the conveying roller pairs 43 and 44, and is discharged out of the apparatus. As a consequence, the original G is stacked on the second discharge section 110. When the trailing end of the original G passes the switchback flapper 82, the switchback flapper 82 performs switching such that the original-dedicated conveying path 81 is closed and the shared conveying path 80 is opened so as to cause the recording sheet S to be conveyed toward the conveying roller pair 40.

The recording sheet S on which printing on the second side has been completed is conveyed toward the shared conveying path 80 by inverse rotation of the discharge roller pair 60.

Figure 7:
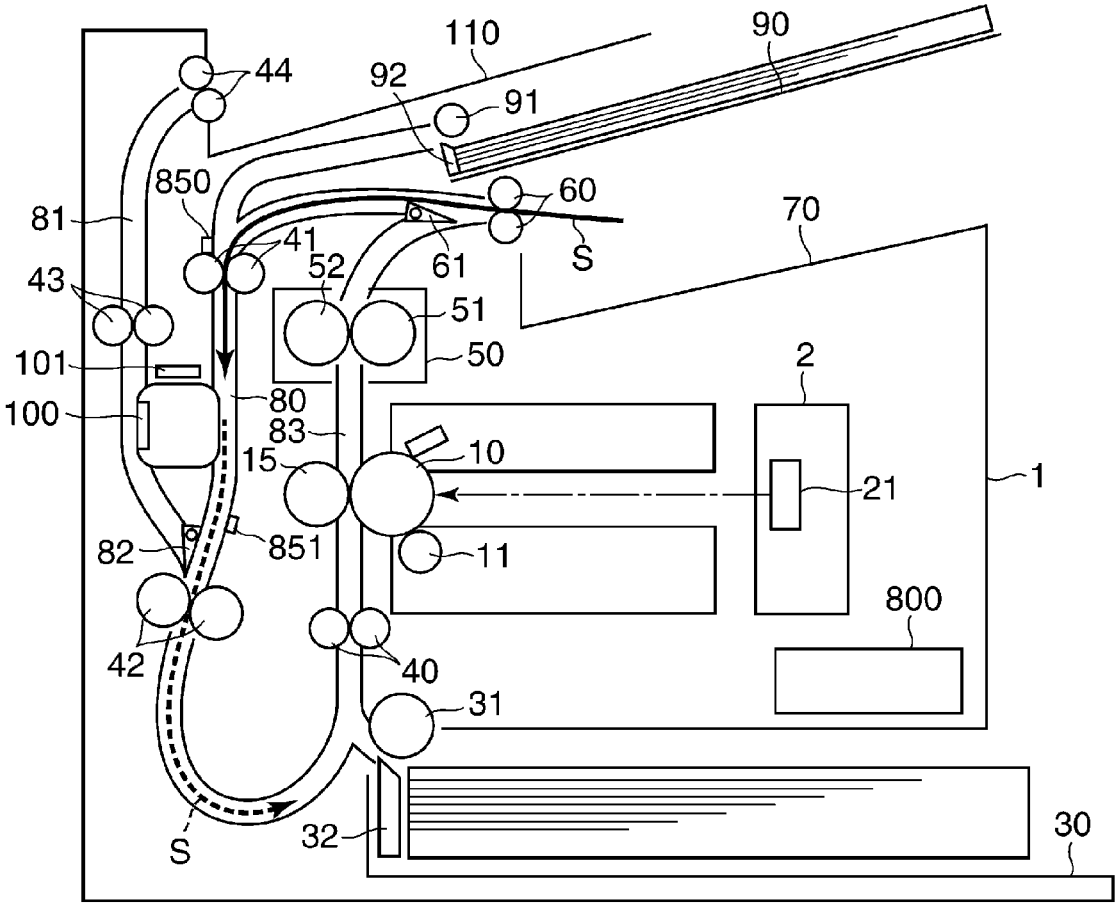
FIG. 7 is a schematic diagram of the image forming apparatus, which is useful in explaining a process for printing the front side of the recording sheet.

FIG. 7 is a schematic diagram of the image forming apparatus 1, which is useful in explaining a process for printing the front side of the recording sheet.

In FIG. 7, the recording sheet S conveyed to the shared conveying path 80 passes the image reading unit 100 which has been rotated to the first reading position, and is conveyed, as indicated by a broken line, to the conveying roller pair 40 via the conveying roller pair 42. Further, the recording sheet S is conveyed to the transfer roller 15 again. The second side of the recording sheet S has already been subjected to printing, and a latent image formed on the photosensitive drum 10 by the light emitting section 21 based on the image data of the first side which is stored in the image memory 804 has been developed by the developing roller 11 into a toner image.

Next, the toner image formed based on the latent image is transferred onto the recording sheet S by the transfer roller 15, and then the recording sheet S is conveyed to the fixing section 50 and so on, whereby printing on the first side is completed. The recording sheet S having the images thus printed on both sides is discharged out of the apparatus onto the first discharge section 70 where it is stacked.

Although in FIG. 7, the recording sheet S indicated by the broken line is conveyed to the transfer roller 15 again, in the present embodiment, it is also possible to convey the original G shown in FIG. 4 to the transfer roller 15 again. The original G conveyed to the transfer roller 15 is conveyed similarly to the recording sheet S appearing in FIGS. 1 and 2.

Figure 8:
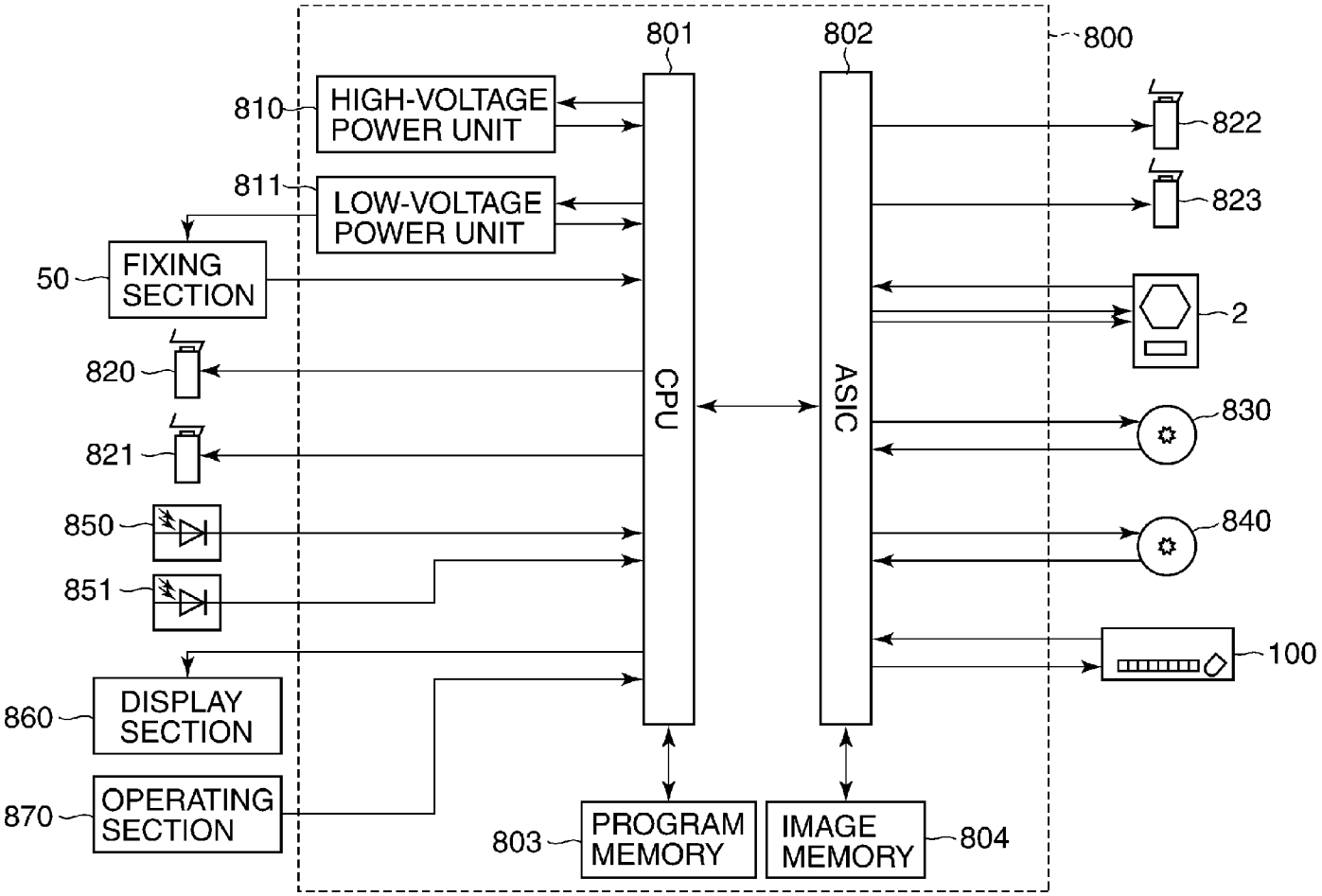
FIG. 8 is a diagram of the general arrangement of electrical equipment and peripheral devices appearing in FIG. 1.

FIG. 8 is a diagram of the general arrangement of the electrical equipment 800 and peripheral devices, appearing in FIG. 1.

In FIG. 8, the electrical equipment 800 comprises a CPU (central processing unit) 801, a high-voltage power unit 810, a low-voltage power unit 811, a program memory 803, an ASIC (application specific integrated circuit) 802, and the image memory 804.

Out of these, the program memory 803 stores various programs and data, and the image memory 804 stores image data representative of images as mentioned above.

The CPU 801 operates according to the various programs and data stored in the program memory 803 to thereby control the overall operation of the image forming apparatus 1. Further, as shown in FIG. 8, the CPU 801 is connected to the high-voltage power unit 810, the low-voltage power unit 811, the fixing section 50, a double-sided-printing flapper solenoid 820, and a switchback solenoid 821. The CPU 801 is further connected to the paper sensors 850 and 851, a display section 860 (display unit), and an operating section 870, the program memory 803, and the ASIC 802.

The high-voltage power unit 810 controls a primary charge bias, a developing bias, a primary transfer bias, and a second transfer bias, which are required for an electrophotographic process, according to instructions from the CPU 801.

The low-voltage power unit 811 supplies power to the fixing section 50 according to instructions from the CPU 801. The CPU 801 monitors temperature using a thermistor (not shown) provided in the fixing section 50, and controls the low-voltage power unit 811 so as to maintain the fixing temperature at a fixed temperature.

The double-sided-printing flapper solenoid 820 drives the double-sided-printing flapper 61 according to instructions from the CPU 801. Further, the switchback solenoid 821 drives the switchback flapper 82 according to instructions from the CPU 801.

A recording sheet-feeding solenoid 822 drives the pickup roller 31 when the recording sheet S is fed, according to instructions from the CPU 801 via the ASIC 802. An original feeding solenoid 823 drives the pickup roller 91 when an original is fed, according to instructions from the CPU 801 via the ASIC 802.

The paper sensors 850 and 851 each send a detection result obtained by optically detecting presence of the recording sheet S or the original G passing them to the CPU 801.

The display section 860 is implemented by a LED (light emitting diode) or a liquid crystal display, and displays various kinds of information to a user according to instructions from the CPU 801. The display section 860 may be provided outside the image forming apparatus 1.

The operating section 870 sends information on a user's operation to the CPU 801. Further, when the CPU 801 receives a copy command sent from the operating section 870 in accordance with a user's operation, the CPU 801 controls the original reading operation and the printing operation in combination. Note that the operating section 870 has a user interface which enables the user to selectively designate execution modes, such as single-sided printing, double-sided printing, reduction layout, image synthesis e.g. for page number printing or copy number printing, and scaling. The above-mentioned reduction layout refers to allocation of a plurality of pages to one page, and scaling includes scaling executed due to a difference in size between an original and a recording sheet. Further, the operating section 870 adds an execution mode, such as scaling, designated by the user, to the copy command.

Further, the above-mentioned optical unit 2 is connected to the CPU 801 via the ASIC 802. The CPU 801 controls a polygon mirror, a motor, and a laser emission element which are included in the optical unit 2 via the ASIC 802 to thereby scan the surface of the photosensitive drum 10 with laser beams to thereby draw a desired electrostatic latent image. To this end, the CPU 801 outputs a control signal to the ASIC 802 to thereby control the optical unit 2.

A main motor 830 drives the conveying roller pair 40, the photosensitive drum 10, the transfer roller 15, the heating roller 51, and the pressure roller 52, for printing on a recording sheet S, according to instructions received from the CPU 801 via the ASIC 802.

A double-sided-printing drive motor 840 drives the pickup roller 91, the conveying roller pairs 41, 42, 43, and 44 according to instructions received from the CPU 801 via the ASIC 802. The main motor 830 and the double-sided-printing drive motor 840 correspond to a conveying unit configured to convey paper material along conveying paths including the shared conveying path 80.

The ASIC 802 performs speed control for the motors of the optical unit 2, the main motor 830, and the double-sided-printing drive motor 840 based on instructions from the CPU 801. The ASIC 802 detects a tach signal which is a pulse signal output whenever each motor is rotated, and controls the speed of each motor by outputting an acceleration or deceleration signal to the motor such that an interval of the tach signal becomes a predetermined interval.

Further, the image reading unit 100 is connected to the ASIC 802. Various signals are exchanged between the image reading unit 100 and the ASIC 802, and a description will be given hereinafter of such operations.

As described above, the construction of the electrical equipment 800 using the ASIC 802 has more merit in that it is possible to reduce the control load on the CPU 801.

Operations performed in printing an image and reading an original will be described again with reference to FIG. 8. First, the operation performed in printing will be described. Upon receipt of a print signal, the CPU 801 drives the main motor 830, the double-sided-printing drive motor 840, and the recording sheet-feeding solenoid 822, to thereby convey the recording sheet S.

After the toner image formed on the surface of the photosensitive drum 10 is transferred onto the recording sheet S by the transfer roller 15, the toner image is fixed by the fixing section 50, and then the recording sheet S is discharged onto the first discharge section 70 by the discharge roller pair 60.

When fixing the toner image, the CPU 801 generates a desired amount of heat by supplying predetermined electric power to the fixing section 50 via the low-voltage power unit 811, and applies the generated heat to the recording sheet S to thereby fuse and fix the toner image on the recording sheet.

Next, the operation performed in reading an original will be described. First, the CPU 801 receives from the host computer, not shown, or the operating section 870, a scan command which instructs reading of an original. Then, the CPU 801 drives the double-sided-printing flapper solenoid 820 and the double-sided-printing motor 840, and operates the original feeding solenoid 823 to thereby cause torque of the double-sided-printing motor 840 to be transmitted to the pickup roller 91 and convey the original G.

The CPU 801 stores the image data read from the image reading unit 100 via the ASIC 802 in the image memory 804 connected to the ASIC 802. Then, the CPU 801 drives the switchback solenoid 821 to operate the switchback flapper 82 such that the original is guided into the original-dedicated conveying path 81, and causes the double-sided-printing drive motor 840 to reversely rotate to convey the original G to the second discharge section 110.

Next, a description will be given of an operation executed when an abnormality occurs during the operation of reading an original and during a printing operation. Note that in the following description, the original G and the recording sheet S are each simply referred to as a paper sheet.

The CPU 801 determines, based on a detection result sent from the paper sheet sensor 850, that a paper sheet is being conveyed along the shared conveying path 80, when the detection result indicates a change from a state where no paper sheet is detected to a state where a paper sheet is detected.

Further, the CPU 801 determines, based on a detection result sent from the paper sheet sensor 851, that a paper sheet is discharged from the shared conveying path 80 and conveyance of the paper sheet is completed, when the detection result indicates a change from a state where a paper sheet is detected to a state where no paper sheet is detected.

The CPU 801 determines that a paper sheet is retained in the shared conveying path 80 when a state where the paper sheet is being conveyed continues for more than a predetermined time period T. The predetermined time period T is set based on time calculated from a conveying speed of the paper sheet and a length of the shared conveying path 80.

Further, when the main motor 830 or the double-sided-printing drive motor 840 detects an abnormality in torque of its own, the main motor 830 or the double-sided-printing drive motor 840 notifies the CPU 801 of the detection result, and the CPU 801 determines, when notified of the detection result, that an abnormality has occurred in the main motor 830 or the double-sided-printing drive motor 840.

Upon determining that an abnormality has occurred in the main motor 830 or the double-sided-printing drive motor 840, the CPU 801 interrupts driving of the main motor 830 and the double-sided-printing drive motor 840 to thereby stop the operation of conveying the paper sheet being conveyed. Further, the CPU 801 transmits, based on the detection results received from the paper sheet sensors 850 and 851, a notification that a paper sheet is retained in the conveying path, to the display section 860.

The display section 860 is configured to display, based on the notification received from the CPU 801, information that a paper sheet is retained in the conveying path, in a manner distinguishing whether the retained paper sheet is a recording sheet S or an original G.

Figure 9A:
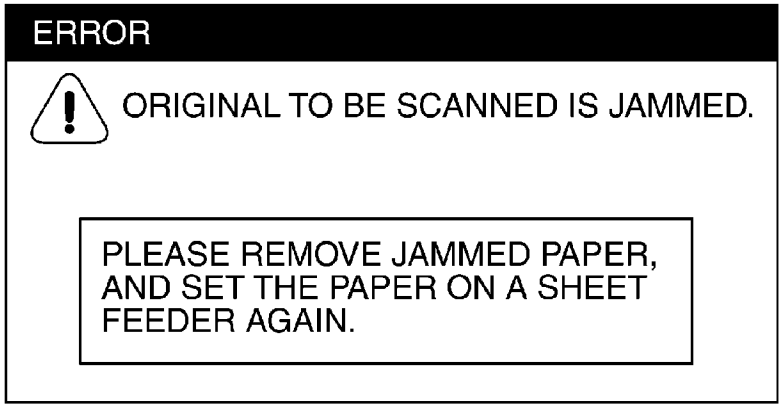
FIGS. 9A and 9B are views each showing an example of a screen displayed on a display section appearing in FIG. 8.
Figure 9B:
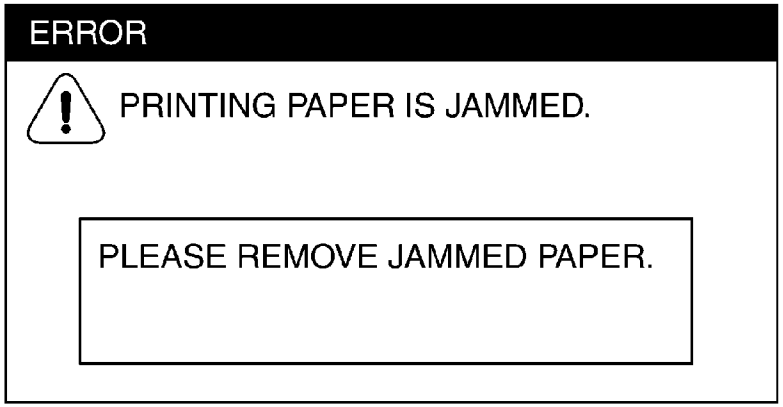

FIGS. 9A and 9B are views each showing an example of a screen displayed on the display section 860 appearing in FIG. 8.

FIG. 9A shows a screen displayed when the display section 860 has received a notification from the CPU 108 that an original G is retained. Further, FIG. 9B shows a screen displayed when the display section 860 has received a notification from the CPU 801 that a recording sheet S is retained. Thus, in the present embodiment, when it is detected that paper material is retained in the conveying path, the display section 860 displays information that the paper material is retained and a type of the retained paper material, to thereby clearly notify the user of whether the retained paper sheet is an original G or a recording sheet S.

FIGS. 10A to 10C, and 11A to 11C are diagrams useful in explaining a method of distinguishing whether a paper sheet retained in the shared conveying path 80 at a time when an abnormality has occurred is a recording sheet S or an original G, which is executed by the CPU 801 appearing in FIG. 8.

Figure 10A:
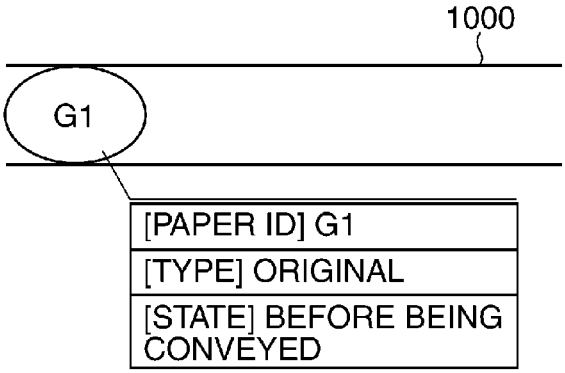
FIGS. 10A to 10C are diagrams useful in explaining a method of distinguishing whether a paper sheet retained in a shared conveying path at a time when an abnormality has occurred is a recording sheet or an original, which is executed by a CPU appearing in FIG. 8.
Figure 10B:
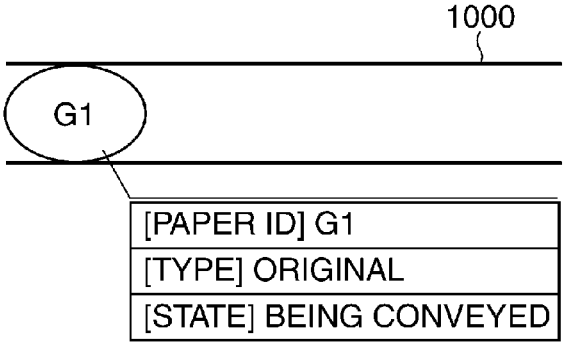
Figure 10C:
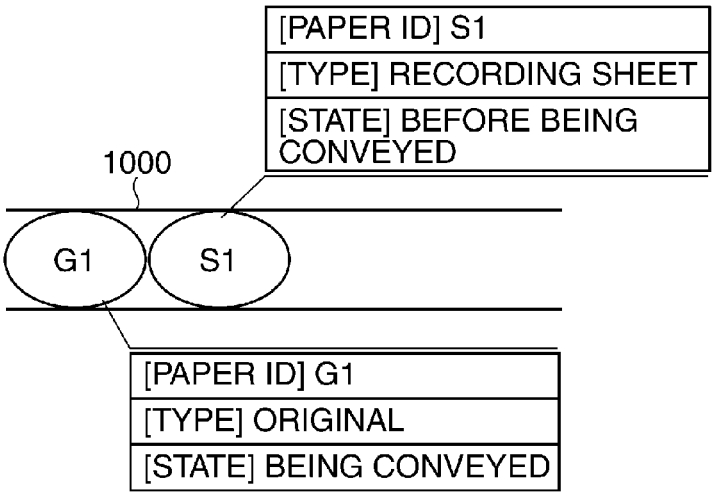

FIGS. 10A to 10C show respective states of an administration queue 1000. The administration queue 1000 is a queue for use in conveyance control of each recording sheet S and each original G conveyed along the shared conveying path 80 by the CPU 801, and is stored in the program memory 803.

The CPU 801 registers recording sheets S or originals G in the administration queue 1000, in an order of conveyance thereof along the shared conveying path 80. In the administration queue 1000, as shown in FIGS. 10A to 10C, items of "paper ID", "type", and "state" are registered for each paper sheet.

The "paper ID" is an ID for identifying a paper sheet. As the "paper ID", "S" and a number indicative of an conveyance order is used for a recording sheet, and "G" and a number indicative of an conveyance order is used for an original. The "type" indicates whether the paper sheet is the recording sheet S or the original G. Further, the "state" indicates a conveying state of the paper sheet in the shared conveying path 80, and the conveying state is indicated as "before being conveyed" or "being conveyed". The "state" is changed according to the detection result sent from each of the paper sheet sensors 850 and 851. Thus, in the administration queue 1000, there are shown a conveyance order of each paper material that is conveyed, a type indicative of whether the paper material that is conveyed is an original or a recording sheet, and a state of conveyance of the paper material.

FIG. 10A shows a state of the administration queue 1000 before a first one of originals G stored in the second sheet feeder 90 is conveyed to the shared conveying path 80.

The CPU 801 registers the first original G1 in the administration queue 1000, and starts to convey the original G1 along the shared conveying path 80. Note that out of paper sheets in the state of "before being conveyed", the CPU 801 starts conveyance from a paper sheet registered earliest.

FIG. 10B shows a state of the administration queue 1000 at a time when the original G is being conveyed.

In the state shown in FIG. 10A, when the CPU 801 determines, based on the detection result sent from the paper sheet sensor 850, that the original G1 is being conveyed along the shared conveying path 80, the CPU 801 rewrites the "state" of the original G1 to "being conveyed" as shown in FIG. 10B.

FIG. 10C shows a state of the administration queue 1000 in which a recording sheet S1 is registered.

As soon as the conveyance of the original G1 is started from the state shown in FIG. 10B, the CPU 801 registers the recording sheet S1 on which an image of the original G1 is to be copied, in the administration queue 1000 as shown in FIG. 10C.

In the state shown in FIG. 10C, the "state" of the recording sheet S1 is "before being conveyed", and further, only the recording sheet S1 is a paper sheet whose "state" is "before being conveyed". Therefore, the CPU 801 starts to convey the recording sheet S1.

Figure 11A:
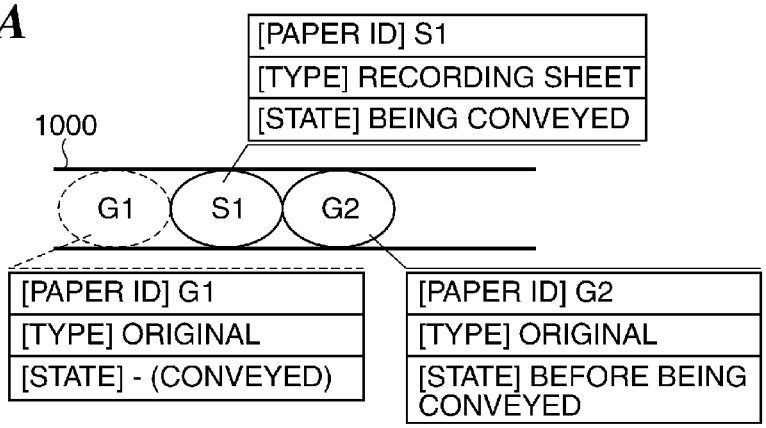
FIGS. 11A to 11C are diagrams useful in explaining the method of distinguishing whether a paper sheet retained in the shared conveying path at a time when an abnormality has occurred is a recording sheet or an original, which is executed by the CPU appearing in FIG. 8.

FIG. 11A shows a state of the administration queue 1000 in which the original G1 is deleted, and an original G2 is registered.

When the CPU 801 determines, based on the detection result sent from the paper sheet sensor 851, that the conveyance of the original G1 being conveyed is completed, the CPU 801 deletes the original G1 to thereby place the original G1 no longer required to be under conveyance control out of conveyance control as shown in FIG. 11A. Further, to convey a next original G2 stored in the second sheet feeder 90, the CPU 801 registers the original G2 in the administration queue 1000 as shown in FIG. 11A.

Further, the CPU 801 conveys the original G2 from the state shown in FIG. 11A, and rewrites the "state" of the original G2 in the administration queue 1000 to "being conveyed".

Figure 11B:
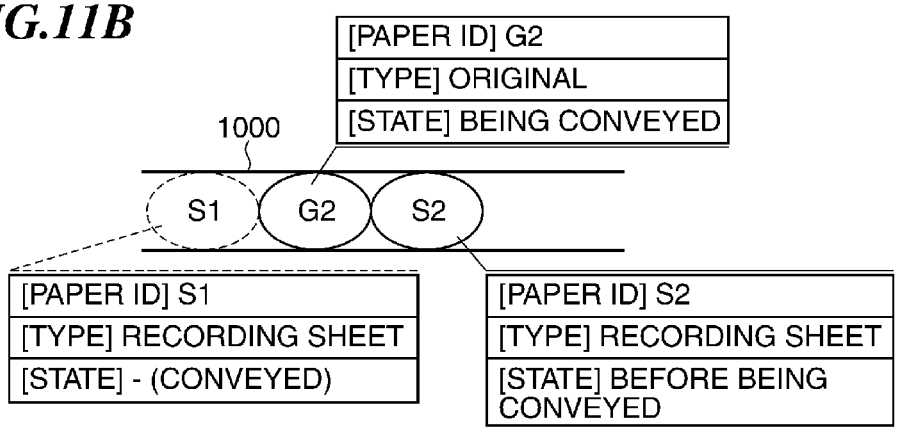

FIG. 11B shows a state of the administration queue 1000 in which the recording sheet S1 is deleted, and a recording sheet S2 is registered.

When the CPU 801 determines, based on the detection result sent from the paper sheet sensor 851, that the conveyance of the recording sheet S1 being conveyed is completed, the CPU 801 deletes the recording sheet S1 as shown in FIG. 11B.

Further, the CPU 801 registers a recording sheet S2 on which the read image of the original G2 is to be copied, in the administration queue 1000 as shown in FIG. 11B.

The CPU 801 carries out the same control on the following recording sheets S and originals G to thereby perform the conveyance control of the recording sheets S and the originals G conveyed along the shared conveying path 80.

Figure 11C:
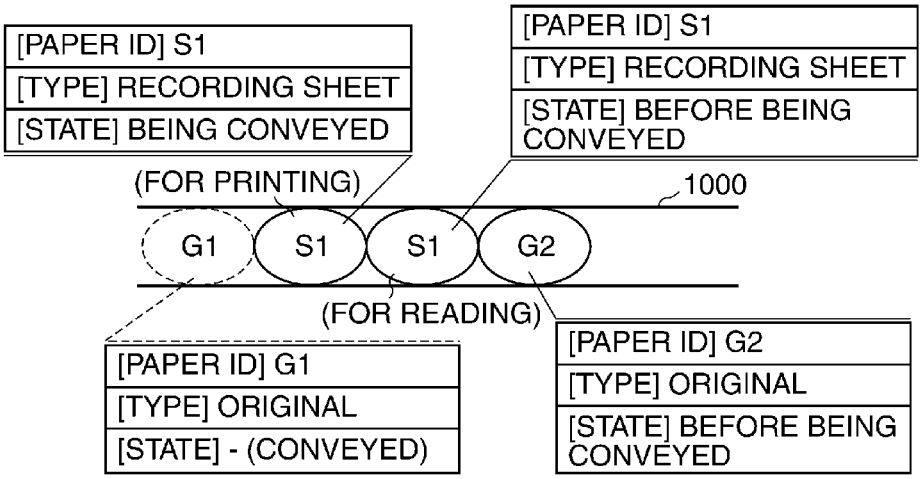

FIG. 11C shows a state of the administration queue 1000 at a time when the conveyance of the original G1 is completed and the recording sheet S1 on which the read image of the original G1 is to be copied is being conveyed.

Note that the administration queue 1000 in FIG. 11C does not show a state following a series of processing operations described with reference to FIGS. 10A to 10C, 11A, and 11B.

The administration queue 1000 in FIG. 11C shows a state occurring in a case where an image is read from an original G and copied onto a recording sheet S, the recording sheet S is further conveyed along the shared conveying path 80, and the image copied on the recording sheet S is read.

The CPU 801 registers the recording sheet S1 (for printing) in the administration queue 1000 so as to copy the image read from the original G1 thereto, and at the same time further registers the recording sheet S1 (for reading) so as to read the image thus copied on the recording sheet S1.

When the conveyance of the original G1 is completed, the CPU 801 deletes the original G1 from the administration queue 1000 as shown in FIG. 11C, and newly registers an original G2 in the administration queue 1000.

According to the administration queue 1000 shown in FIG. 11C, the recording sheet S1 for printing is conveyed first, and when printing on the recording sheet S1 is completed, the recording sheet S1 on which printing is completed is conveyed next as the recording sheet S1 for reading.

With the above-described administration queue 1000, the CPU 801 can identify whether a retained paper sheet is a recording sheet S or an original G.

More specifically, when the CPU 801 determines that a paper sheet is retained in the shared conveying path 80, the CPU 801 consults the administration queue 1000, to thereby distinguish, based on "type" of a paper sheet whose "state" is "being conveyed", whether the retained paper sheet is a recording sheet S or an original G". Then, the CPU 801 sends the identification result to the display section 860.

As an example, when the CPU 801 determines that a paper sheet is retained in the shared conveying path 80, if the administration queue 1000 consulted by the CPU 801 indicates the state shown in FIG. 11A, the CPU 801 determines that the recording sheet S1 is retained in the shared conveying path 80.

As described above, in the present embodiment, when it is detected that paper material is retained in a conveying path, it is possible to distinguish whether the retained paper material is an original or a recording sheet.

Next, a second embodiment of the present invention will be described. In the second embodiment, there is illustrated a variation of the display screens shown in FIGS. 9A and 9B, and the image forming apparatus 1 according to the second embodiment has the same arrangement as that of the first embodiment. Further, the image forming apparatus 1 is configured to be capable of detecting the size of an original G and the size of a recording sheet S.

The CPU 801 stores an execution mode which is added to a job, such as a job instructed by a copy command received from the operating section 870, which requires reading of the original and image formation to be executed in combination, in the program memory 803. When the CPU 801 determines that a paper sheet is retained in the shared conveying path 80, the CPU 801 refers to the stored execution mode, and determines whether or not the original G and the recording sheet S on which copying is performed are different in size.

Figure 12A:
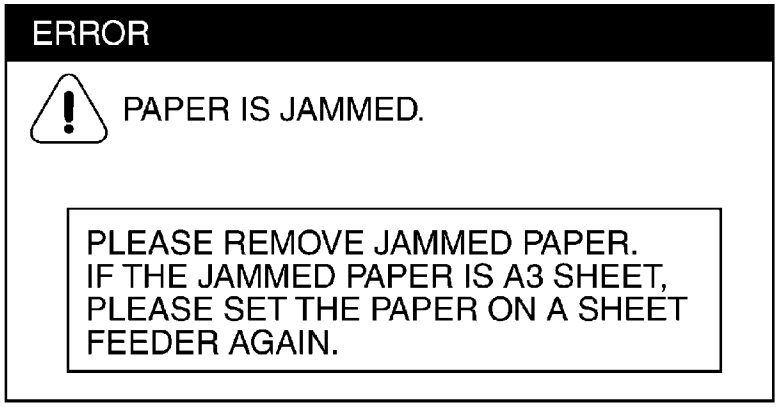
FIGS. 12A and 12B are views each showing an example of a screen displayed on a display section of an image forming apparatus according to a second embodiment of the present invention.
Figure 12B:
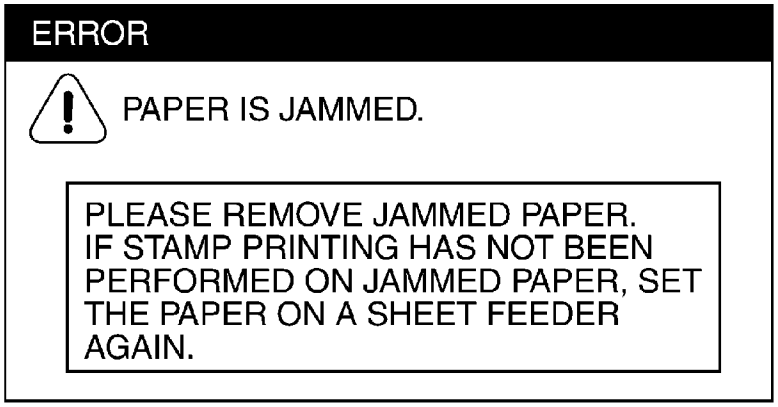

FIGS. 12A and 12B are views each showing an example of a screen displayed on the display section 860 appearing in FIG. 8.

FIG. 12A shows an example of the screen displayed on the display section 860 appearing in FIG. 8 when the original G and the recording sheet S are different in size.

When the CPU 801 determines that the original G and the recording sheet S are different in size, the CPU 801 sends the determination result to the display section 860, and the display section 860 displays the screen shown in FIG. 12A.

Note that FIG. 12A shows an example in which the original G is an A3 size sheet, and the recording sheet S is a sheet of a size other than the A3 size.

Further, the execution mode may include a designation of the size of the original G and the size of the recording sheet S, and the CPU 801 may determine based on the sizes specified in the execution mode whether or not the original G and the recording sheet S are different in size.

FIG. 12B shows an example of the screen displayed on the display section 860 when an image of the original G and an image printed on the recording sheet S are different.

The CPU 801 refers to the execution mode stored in the program memory 803. If the CPU 801 determines that stamp printing is specified, it sends the determination result to the display section 860, and the display section 860 displays the screen shown in FIG. 12B. Note that the term "stamp printing" refers to a type of printing in which a stamp or a seal is additionally printed.

Further, the CPU 801 may determine, based on a designation of other image synthesis, such as copy number printing, reduction layout, or scaling, that the image of the original G and the image printed on the recording sheet S are different.

In cases where the CPU 801 simultaneously controls an image reading operation and a printing operation, not only due to receipt of a copy command but also due to receipt of a print command instructing printing and a scan command instructing scanning, the screens shown in FIGS. 12A and 12B may be displayed. As described above, in the present embodiment, if it is detected that a paper sheet is retained during execution of a job which requires original reading and image formation are to be executed in combination, relevant information on the job is indicated, whereby contents on which the execution mode added to the job is further reflected are displayed on the display section 860. Here, the contents on which the execution mode is reflected are those including a sheet size and stamp printing, in the respective cases of FIGS. 12A and 12B.

Next, a third embodiment of the present invention will be described. In the third embodiment, there is illustrated another variation of the display screens shown in FIGS. 9A and 9B, and the image forming apparatus 1 according to the third embodiment has substantially the same arrangement as that of the first embodiment, except that additional paper sheet sensors are provided.

Figure 13:
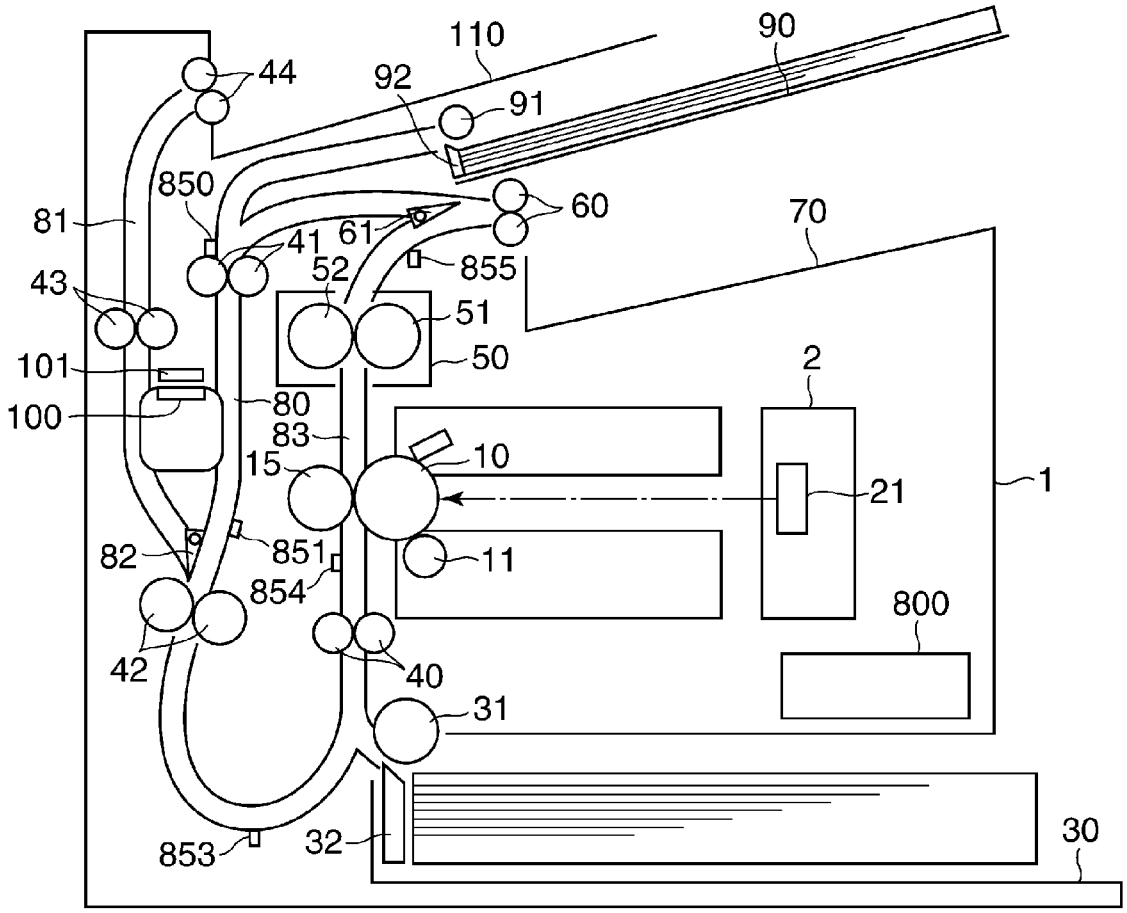
FIG. 13 is a schematic diagram of an image forming apparatus according to a third embodiment of the present invention.

FIG. 13 is a schematic diagram of the image forming apparatus 1 according to the third embodiment.

In FIG. 13, the image forming apparatus 1 has the additional paper sheet sensors, denoted by respective reference numerals 853, 854, and 855, are newly provided. The additional paper sheet sensors 853, 854, and 855 optically detect presence of a recording sheet S or an original G passing these sensors, and send detection results to the CPU 801, similarly to the above-mentioned paper sheet sensors 850 and 851.

The paper sheet sensor 853 detects a paper jam occurring between the conveying roller pair 42 and the conveying roller pair 40. The paper sheet sensor 854 detects a paper jam occurring between the conveying roller pair 40 and the fixing section 50. The paper sheet sensor 855 detects a paper jam occurring between the discharge roller pair 60 and the fixing section 50.

Therefore, the CPU 801 is capable of detecting a paper jam at more positions than in the first and second embodiments.

Figure 14:
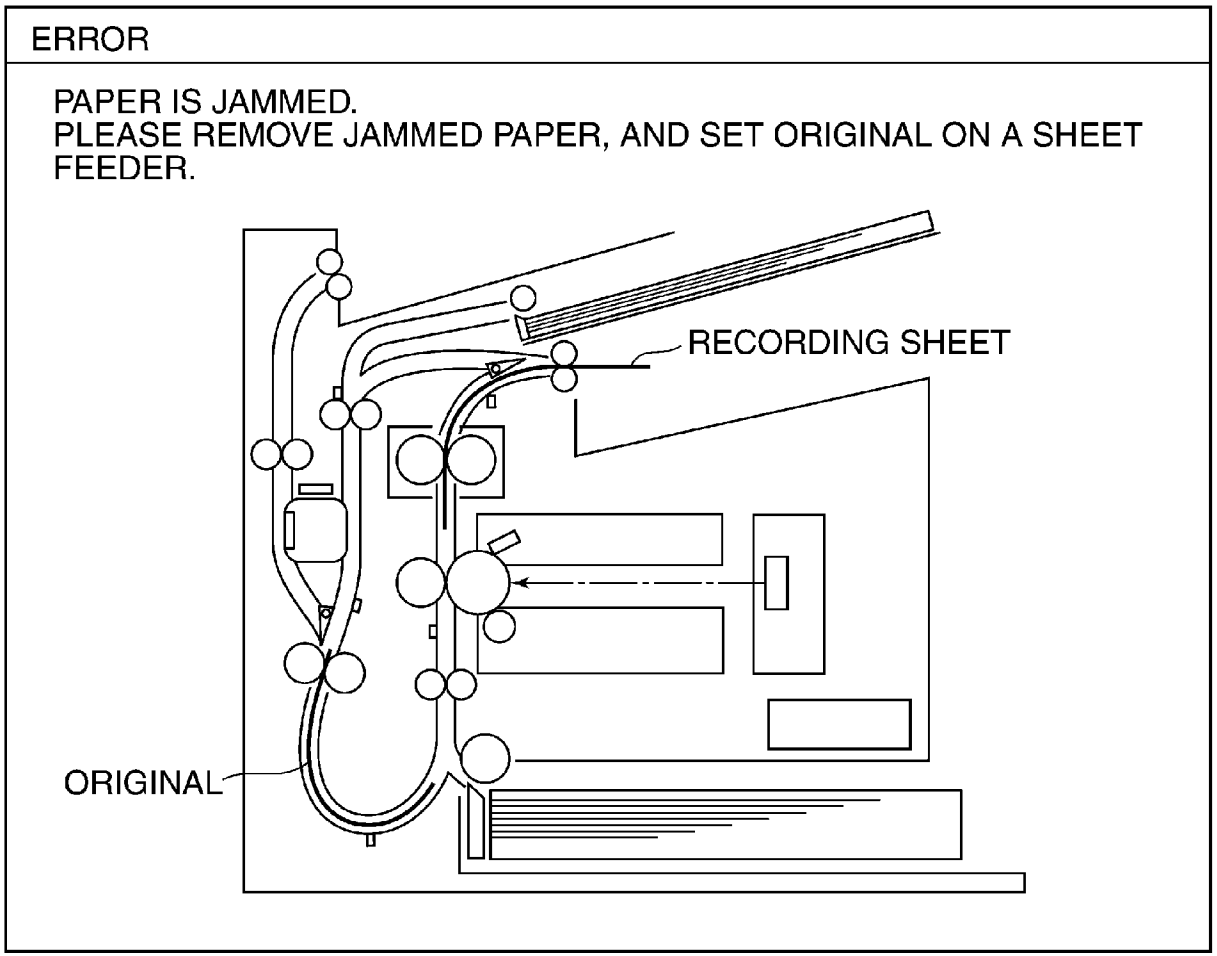
FIG. 14 is a view showing an example of a screen displayed on a display section of the image forming apparatus according to the third embodiment.

FIG. 14 is a view showing an example of a screen displayed on the display section 860 appearing in FIG. 8.

Differently from the screens shown in FIGS. 9A, 9B, 12A, and 12B, the screen shown in FIG. 14 shows the conveying paths in the image forming apparatus 1 and further indicates a position where a paper jam has occurred, which makes it easier for the user to understand a state of the paper jam.

Further, as described with reference to FIGS. 10A to 10C, and 11A to 11C, since it is possible to determine whether a retained paper sheet is an original G or a recording sheet S, it is also possible to display whether the paper sheet indicated on the screen as retained in the conveying path is an original G or a recording sheet S. Thus, in the present embodiment, an illustration showing the conveying paths and a position of a retained paper material in the conveying paths are further displayed on the display section 860.

As described above, in the present embodiment, the shared conveying path 80 is configured to serve both as a conveying path, different from the image-forming conveying path 83, for use in conveying a recording sheet during double sided printing and as the original conveying path, whereby it is made possible to provide an image forming apparatus which is inexpensive, capable of performing printing during an reading operation, and capable of reducing reading time.

Further, the image forming apparatus enables the user to distinguish between types of paper material retained in a conveying path, which makes it possible to improve usability at a time when a paper jam has occurred.

For example, when retained paper material is an original to be read, the retained paper material is removed, and further, the removed paper material is set in an original feeding position again so as to reread the original. When the retained paper material is a recording sheet, the paper sheet is removed. Thus, in a case where a recovery procedure is different depending on the type of retained paper material, the user can easily determine a recovery procedure to be carried out.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-105994, filed May 7, 2012, which is hereby incorporated by reference herein in its entirety.

What is claimed is:

1. An image forming apparatus comprising:

a reading unit configured to read an original;

an image forming unit configured to form an image on a recording material;

a conveying unit having a shared conveying path configured to convey the original and the recording material;

a jam detection unit configured to detect an occurrence of a jam of the original or the recording material in the shared conveying path; and a display control unit configured to, when the occurrence of the jam in the shared conveying path is detected by said jam detection unit, control a display unit to display a notification for notifying a user of the occurrence of the jam, in a manner distinguishing between the original and the recording material.

2. The image forming apparatus according to claim 1, wherein said display control unit further causes said display unit to display a position of the original of the recording material retained in the shared conveying path.

3. The image forming apparatus according to claim 1, wherein:

said jam detection unit includes at least one sheet detection unit each configured to detect the original or the recording material in the shared conveying path, and configured to detect the occurrence of the jam of the original or the recording material, based on a result of detection by said at least one sheet detection unit, and said display control unit is configured to control, based on the result of detection by said at least one sheet detection unit, said display unit to display the notification, in a manner distinguishing between the original and the recording material.

4. The image forming apparatus according to claim 1, wherein the shared conveying path is used for reading one side of the original by said reading unit, and is also used for reversing the recording material on which double-sided-printing is to be performed by said image forming unit.

5. The image forming apparatus according to claim 1, wherein in a case where a copy job for printing an image of the original read by said reading unit on the recording sheet by said image forming unit is being executed, and at the same time the occurrence of the jam is detected by said jam detection unit, said display control unit controls said display unit to display the notification, in a manner distinguishing between the original and the recording material.

6. The image forming apparatus according to claim 1, wherein in the case where a scan job for reading the original by said reading unit and a print job for printing an image on the recording material by said image forming unit are being executed, respectively, and at the same time the occurrence of the jam is detected by said jam detection unit, said display control unit controls said display unit to display the notification, in a manner distinguishing between the original and the recording material.

7. A method of controlling an image forming apparatus including a reading unit configured to read an original, an image forming unit configured to form an image on a recording material, and a conveying unit having a shared conveying path configured to convey the original and the recording material, the method comprising:

a detection step of detecting an occurrence of a jam of the original or the recording material in the shared conveying path; and a display control step of controlling, when the occurrence of the jam in the shared conveying path is detected in the detection step, a display unit to display a notification for notifying a user of the occurrence of the jam, in a manner distinguishing between the original and the recording material.

8. A non-transitory storage medium storing a program for causing a processor included in an image forming apparatus to execute a method of controlling the image forming apparatus including a reading unit configured to read an original, an image forming unit configured to form an image on a recording material, and a conveying unit having a shared conveying path configured to convey each of the original and the recording material, the method comprising:

a detection step of detecting an occurrence of a jam of the original or the recording material in the shared conveying path; and a display control step of controlling, when the occurrence of the jam in the shared conveying path is detected in the detection step, a display unit to display a notification for notifying a user of the occurrence of the jam, in a manner distinguishing between the original and the recording material.

* * * * *